US009970232B2

(12) United States Patent
Koenitz

(10) Patent No.: US 9,970,232 B2
(45) Date of Patent: May 15, 2018

(54) MOUNTABLE COVER, BLIND AND / OR SHADE FOR A WINDOW OR SKYLIGHT

(71) Applicant: Chris Koenitz, Flanders, NJ (US)

(72) Inventor: Chris Koenitz, Flanders, NJ (US)

( * ) Notice: Subject to any disclaimer, the term of this patent is extended or adjusted under 35 U.S.C. 154(b) by 0 days. days.

(21) Appl. No.: 14/121,448

(22) Filed: Sep. 8, 2014

(65) Prior Publication Data

US 2016/0069127 A1 Mar. 10, 2016

(51) Int. Cl.
*E06B 9/02* (2006.01)
*E06B 9/24* (2006.01)

(52) U.S. Cl.
CPC . *E06B 9/24* (2013.01); *E06B 9/02* (2013.01)

(58) Field of Classification Search
CPC ..... E06B 9/24; E06B 2009/527; E06B 9/02
See application file for complete search history.

(56) References Cited

U.S. PATENT DOCUMENTS 1,915,590 A * 6/1933 Bevans ..... 49/417
2,407,632 A * 9/1946 Dreyfus ..... 139/426 R
2,935,769 A * 5/1960 Lutes ..... E06B 3/285 160/90
4,041,663 A * 8/1977 Mazzoni ..... E06B 7/28 428/428
4,126,174 A 11/1978 Moriarty et al. ..... 160/266
4,261,410 A 4/1981 Standiford ..... 160/269
4,311,183 A * 1/1982 Herbst et al. ..... 160/37
4,562,675 A * 1/1986 Baigas, Jr. ..... E06B 3/285 160/354
4,587,997 A * 5/1986 Brooks ..... D03D 9/00 139/420 R
4,610,292 A 9/1986 Hausmann et al. ..... 160/120
4,883,109 A 11/1989 Sonderby ..... 160/132
5,088,543 A 2/1992 Bilbrey ..... 160/310
(Continued)

FOREIGN PATENT DOCUMENTS

DE 20316919 3/2004 ..... E04D 13/03
WO WO 2009/114437 9/2009 ..... E04F 10/06
WO WO 2012/131472 10/2012 ..... E06B 3/67

OTHER PUBLICATIONS

Internet Publication "Skylight Blinds" found at http://www.homedepot.com/b/Doors-Windows-Windows-Skylights-Blinds/N-5yclvZc5f0.

*Primary Examiner* — Katherine W Mitchell
*Assistant Examiner* — Abe Massad
(74) *Attorney, Agent, or Firm* — Ernest D. Buff & Associates, LLC; Ernest D. Buff, Esq.; Margaret A. LaCroix, Esq.

(57) ABSTRACT

A mountable cover provides a shade or blind for a window and/or skylight. The mountable cover comprises a mounting frame having a top wall, side walls and a bottom wall adapted to be removably mounted within a window frame structure housing a window. The mounting frame is appointed to abut and sit flush against the window frame structure. Additionally, the mountable cover comprises a panel located within the mounting frame comprising a material adapted to interface with solar properties traversing the window and sit parallel to the window. The mountable cover further comprises fastening means appointed to engage with the window frame structure for mounting and removing the mounting frame from the window frame structure. Windows suitable for the mountable cover include a vast array of window structures, elevated windows, and skylights.

7 Claims, 13 Drawing Sheets

(56) References Cited

U.S. PATENT DOCUMENTS

| | | | | | |
|---|---|---|---|---|---|
| 5,123,211 | A * | 6/1992 | Schlicht | E06B 3/685 | 29/449 |
| 5,179,992 | A * | 1/1993 | Okarski | E04D 13/033 | 160/327 |
| 5,204,777 | A | 4/1993 | Curshod | 359/596 | |
| 5,465,774 | A * | 11/1995 | Smith | E06B 9/04 | 160/368.1 |
| 5,568,832 | A | 10/1996 | Eddy | 160/374 | |
| 5,839,462 | A * | 11/1998 | Randall | E04H 6/04 | 135/128 |
| 5,850,861 | A | 12/1998 | Silverberg | 160/107 | |
| 6,089,301 | A * | 7/2000 | Smith | E06B 9/04 | 160/368.1 |
| 6,223,804 | B1 | 5/2001 | Toti | 160/199 | |
| 6,601,637 | B2 | 8/2003 | Toti | 160/199 | |
| 6,672,366 | B1 * | 1/2004 | Wade | E06B 9/24 | 160/368.1 |
| 6,675,860 | B2 * | 1/2004 | Steele | E06B 3/285 | 160/237 |
| 6,918,426 | B1 * | 7/2005 | Westby | E06B 9/24 | 160/368.1 |
| 8,074,698 | B2 | 12/2011 | Allsopp | 160/107 | |
| 8,881,788 | B1 * | 11/2014 | Spencer | 160/180 | |
| 2004/0154753 | A1 | 8/2004 | Tagtow et al. | 160/23.1 | |
| 2007/0199259 | A1 * | 8/2007 | Parsley | G08B 13/04 | 52/203 |
| 2010/0288455 | A1 * | 11/2010 | Liscano | 160/372 | |
| 2011/0056135 | A1 | 3/2011 | Cochran | 49/62 | |

* cited by examiner

MOUNTABLE COVER, BLIND AND / OR SHADE FOR A WINDOW OR SKYLIGHT

1. FIELD OF THE INVENTION

The present disclosure generally relates to covers, blinds and/or shades for a window or skylight; and more particularly, to framed covers, blinds and/or shades that are removably mounted on windows, elevated and hard to reach windows and skylights.

2. DESCRIPTION OF THE PRIOR ART

Direct sunlight can cause fading, bleaching and darkening in furniture and flooring. It can additionally decrease the efficiency of cooling/heating systems, due substantially in part to the direct exposure of sunlight. While basic window treatments, such as blinds and curtains, are provided for typical home window structures, skylight and elevated windows are difficult to cover with window treatments.

Skylights and elevated windows are frequently installed in blinding constructs both for their aesthetic appeal and functionality in providing natural lighting to a room or area. However, these window constructs are particularly prone to energy inefficiency owing to solar heat buildup within the room. Additionally, skylights and elevated windows increase exposure to UV rays and light within the room causing fading, bleaching and darkening furniture and flooring over time. Often, these windows require specialized coverings formed for the particular skylight or elevated window structure. Even when more universal type coverings are provided, these coverings have disadvantages. Such coverings are generally either integrated within the window structure, causing the window construct to become much more expensive, or require separate installation and maintenance. These separately installed coverings are not only expensive, but they are difficult to install. If the installation is for an external/outside covering, then there exists an added concern that improper installation will result in water leakage, causing structural damage and property damage over time.

Examples of various window treatment products are set forth below in summation:

U.S. Pat. No. 4,126,174 to Moriarty et al. discloses a flexible sheet rollup window structure used in conjunction with a conventional window sash frame as an auxiliary or storm window. The invention includes an elongated sheet of thin, flexible plastic material (vinyl) which is designed to be supported and stored or dispensed by means of elongated spring rollers. An auxiliary guide roller is provided to direct the film into a straight-line plane.

U.S. Pat. No. 4,261,410 to Standiford discloses a self-adjusting, self-storing rollaway inside storm window for use on conventional windows, which can be quickly put up and taken down as desired. The rollaway inside storm window includes a transparent flexible panel mounted on and constantly tensioned at the top end by a spring-retracting roller in the manner of a window shade and deployable over a self-adjusting spring biased extension rod securable between the sides of a window frame at the top, and at the bottom loop-affixed around a similar self-adjusting spring biased extension rod also securable between the sides of the window frame; a special shock cord deployed along each side of the panel between the upper and lower self-adjusting spring loaded rods biases the vertical edges of the panel in a direction for sealing against the window frame structure; intermediate disconnects are provided in the shock cord, and special ends on the self adjusting spring loaded rods adapt them for securance to window frame structures of different types.

U.S. Pat. No. 4,610,292 to Hausmann et al. discloses an insulating window shade assembly including a first roller carrying an insulating shade and a second roller carrying a cover fabric. The shade and cover fabric are supported in essentially face to face relationship, and their bottoms are secured together by a Velcro-type fastener. The cover fabric conceals the insulating shade, it may be removed from the shade for cleaning or may be changed and it may be adjusted for smoothness and to compensate for any stretching which occurs in the materials.

U.S. Pat. No. 4,883,109 to Sonderby discloses a roller blind for skylights, having a roller blind compartment which can be fitted on the upper part of the blind, a winding shaft rotatably mounted in the compartment and a strap drum coaxially connected, for joint rotation, to the winding shaft for a pulling strap, has a plurality of strap deflecting elements arranged in the roller blind compartment, which elements deflect the pulling strap, extending from the strap drum, with axial strap twisting, firstly substantially parallel to the winding shaft, then substantially parallel to the central plane of the strap drum and then substantially perpendicular to the plane of exit of the roller blind toward the window, whence, in the installed position, it runs through a strap opening in the outer covering of the frame upper piece between the latter and a cover part engaging underneath its outer covering directly to a strap winder, preferable fitted above the window.

U.S. Pat. No. 5,088,543 to Bilbrey discloses a shade unit having a frame defining a skylight opening, to which is attached a motor assembly and a shade assembly, a control unit consisting of an open stop switch, a close stop switch controls the motor assembly with a relay switch charging the motors polarity. A wall switch controls the relay switch and a photoelectric switch which can also control the relay switch.

U.S. Pat. No. 5,204,777 to Curshod discloses an energy-efficient barrier utilizing thin slats, on one side of which are formed a number of reflective surfaces. The reflective surfaces are oriented at an angle, with respect to the face of the slat, to maximize reflection of the rays of the sun. The parallel reflective surfaces are formed as a series of ridges along the length of a slat and as the treads of a series of stairsteps formed along the length of a slat. In a skylight assembly, one or more spacer members are provided having complementary slots formed therein for engagement with corresponding slots formed in the slats to properly align the slats with respect to the sun. The slats can be fixed as in a skylight, or variable such as in a Venetian blind.

U.S. Pat. No. 5,568,832 to Eddy discloses a skylight shade formed of a frame and engage-able with the sides of a skylight opening and a filter sheet supported by the frame. The frame is formed from a plurality of adjustable rods which each have an outer member and an inner member which is adjustably received within the outer member and engages a spring therein. The outer member has an aperture extending perpendicularly there through adjacent one end and receives an end of an inner member of another rod therein. The filter sheet has attachment sleeves which are received around the rods for attaching the filter sheet to the frame. The rods contract via springs to allow each rod to be received within the skylight opening and are forcibly biased via springs the rod into secure engagement with the side of the skylight opening.

U.S. Pat. No. 5,850,861 to Silverberg discloses an electrostatically controlled blind system for use in limiting the passage of light through windows, doors, and skylights in building structures. The blind system comprises a plurality of elongated, electroconductive louvers which are pivotally supported within an electroconductive peripheral frame. The blind system is inserted between sheets of insulated glass having an electroconductive coating and is thereby insulated from the ambient atmosphere. A voltage converter converts alternating current to an electrostatic charge which is distributed on the surface of the louvers causing them to repel each other.

U.S. Pat. Nos. 6,223,804 and 6,601,637 to Toti disclose hinge mechanisms and window cover systems. The hinges and window covers generally include: a vertical slat blind arrangement including an upper traverse track; carriers or trolleys suspended from the traverse track; a mechanism for horizontally traversing the carriers along the track; and an array of vertically oriented slats suspended from the carriers for opening and closing traversing movement along the traverse track. Adjacent slats are pivotally joined along their vertical length by a hinge mechanism comprising a first generally c-shaped hook or hinge member extending along the length of a first of the adjacent slats and a second mating, generally c-shaped hook or hinge member extending along the length of the second of the adjacent slats.

U.S. Pat. No. 8,074,698 to Allsopp discloses a window blind frame system comprising a window blind secured to a frame and optionally at least one frame-securing clip for releasably retaining the frame in position relative to the window casing. The frame may comprise at least two angle joints connecting at least three extruded portions to form a substantially rigid structure, wherein a window blind may be attached to the frame and wherein the frame is configured to interact with a frame-securing clip which releasably retains the frame in position relative to a window casing. The components of the window blind frame system may be provided in kit form. Methods of assembly and fitting of the window blind frame system are also provided.

U. S. Patent Application No. 2004/0154753 to Tagtow et al. discloses a retractable flexible screen for installation to a frame of a fenestration product, the frame having opposite pairs of frame members. The flexible screen extending and retracting across an opening in the fenestration product and including flexible screen material and a roller system upon which the screen material is unwound and wound. A pair of mounting brackets are provided, each attachable to one of the pairs of frame members. A control bar connects to the screen material and moves along a pair of tracks each mountable to the same pair of frame members, the screen material extending from the roller system to one of the other pair of frame members. A gripper system mounts in the tracks and grips the screen material in a closed flexible screen. A spring tensioning system provides post-installation access to adjust the tension of a spring within the roller system.

U. S. Patent Application No. 2011/0056135 to Cochran discloses an energy saving grate system installed outside a building or structure in warm weather that reduces heating due to infrared radiation (IR) from sunlight. For a window application the grate acts as a sunshade to block or diffuse the IR and ultraviolet (UV) portions of sunlight while passing visible light. The grate cell size, depth, cell surface characteristics, and mounting details near the sash determine system performance of sunlight control, of the view through the grate, and of the exterior appearance. The grate is removable for cool weather. The grate system can cool various surfaces and requires no operating adjustments. It can be applied near most windows (including skylights) on all sides of a building where impinging sunlight causes unwanted heating. Compared to external solar thin mesh screens the grate system can provide more open area for a given performance in reduced IR heating.

Foreign Patent Application No. DE20316919 to Colt Internat Holdings Ag Baar discloses a sun shade that comprises an adjustable angle support connected to the window and containing spaced apart sun blind slats. The skylight comprises a window frame which can be mounted in a setting frame in the roof and is pivotable about at least one substantially horizontal axis. The sun shade is on the outside of the window.

Foreign Patent Application No. WO/2009/114437 to Kirby et al. discloses a self-contained tensioned roller shade system that can be easily installed in an opening, such as a window or a skylight. The roller shade system includes a frame, a roller tube rotatably mounted between side channels of the frame adjacent a first end of the frame, and a shade fabric windingly received around the roller tube. A tensioning cord is operatively coupled between the roller tube and a fabric end of the shade fabric, and windingly received about the roller tube. A pulley is operatively coupled to the frame adjacent the second frame end and windingly receives the tensioning cord.

Foreign Patent Application No. WO/2012/131472 to Stoyke discloses a secondary interior window insert which comprises a frame, at least two panes, one or two flexible integral glass sealing lips, a spacer insert located between the panes, a sealing plate and means to tie up panes, frame, sealing plate and glass sealing lips. The device may further comprise integral friction fit seals, a jamb cover. The insert window contains several sheets of glass or plastic that creates additional dead air spaces. The insert window frame contains a groove to retain a cover strip that extends from the frame to insulate the cold window jamb. It also represents an improvement with respects to ease of assembly by having the seals extruded as integral part of the frame.

Internet Publication "Skylight Blinds" found at http://www.homedepot.com/b/Doors-Windows-Windows-Skylights-Skylight-Blinds/N-5yc1vZc5f0 discloses skylights and manually operated black-out blinds for skylights.

Despite the advent of the aforementioned skylight/window coverings, problems for specialized window coverings still exist. For example, several of the heretofore known and utilized covers are appointed to be integrated within the window structure itself. As a result, window structures having the covering or blind integrated into the construct or frame result in a product that is expensive to manufacture, package, install and replace, and more prone to damage owing to several moving parts. Other types of coverings require extensive installation and maintenance. Separately installed coverings are often complex and expensive, and difficult to install. Due to the required structural installation there exists an added concern that improper installation will result in structural damage to the window, window frame, and/or building itself. Such damage may adversely affect structural integrity and trigger potential water leakage, causing real and personal property damage over time.

Accordingly, there exists a need for a widow covering particularly suitable for skylights and/or elevated windows, wherein the window covering includes a cover, blind, or shade composed of a light weight material that it is easy to install and to clean. Further, there is a need in the art for a covering for a skylight/elevated window that is lightweight and readily placed in position with minimal effort by a lay person. Additionally, there is a need in the art for a window covering for skylights wherein the covering comes in conventional skylight/elevated window sizes and is readily inserted within the skylight frame resulting in a flush clean fitting that can be readily removed when desired or for cleaning.

SUMMARY OF THE INVENTION

The present invention is directed to a mountable cover, blind and/or shade for a stationary window or skylight. Briefly stated, the subject mountable cover is appointed to provide a window covering, particularly contemplating a skylight or window cover, or blind, composed of a light weight material and having four pins/fastening means so that it is easy to install and to clean. The subject mountable cover for windows or skylights provides a shade or decorative cover that is lightweight and readily placed in position. When used in position under a skylight, it keeps the surrounding environment cooler in summer and warmer in winter. It also prevents the sun's rays from fading carpets and upholstery. Generally, skylights come in conventional sizes and the subject mountable cover is offered in a variety of sizes, including the conventional sizes of skylights. The pins for fastening means can be made in different sizes. The subject mountable cover shade/blind can be premade in the conventional sizes or can be custom made or sized. Materials composing the subject mountable cover can vary. The subject mountable cover preferably has a variety of functions, including blocking light, reducing heat buildup, insulating properties to keep heat in during colder/winter months, as well as a decorative function. Pins are constructed as short pins or longer pins.

The term window frame herein includes window frame structures formed in dry wall and/sheet rock, window frames secured to a structures wall or ceiling, or window frame structures directly abutting window glass. The subject mountable cover may be mounted within any of the aforesaid frame structures and may be stationary, such as for stationary windows including skylights generally, or movable, such as for movable windows such as sliding glass doors or double hung windows. Where the mountable cover is mounted within a movable window structure, the cover is mounted within the shallow frame directly abutting the glass so that the cover, frame and window move together as a unit. When being utilized with mounted windows, the frame of the mountable cover itself is very shallow in depth so that it preferably sits substantially flush within the movable window frame.

Generally stated, the subject mountable cover is constructed having a mounting frame forming corners (flat, angled or curved), with an insert panel located therein. Insert panel is constructed as a blind, shade, window cover, heat reflective material, and/or heat insulation material adapted to provide a window covering for window or skylight. Mounting frame includes at least one fastening means (optionally formed with at least one aperture drilled therein adapted to receive a pin; or a latch). The fastening means is located on at least one side of the mounting frame. Alternatively, there may be at least two fastening means preferably located on the opposing side of the mounting frame. The fastening means comprises apertures within the mounting frame and a pin adapted to be received within and traverse the aperture to protrude therefrom and abut against a window frame so that the subject mountable cover is secured within the window. The mounting frame can also be made in standard sizes to fit within window glass framing. Mounting frame can be composed of a plethora of materials, including wood materials that correspond to typical wood colors/plastic colors utilized for current window frames.

In a first embodiment, the subject mountable cover comprises a mounting frame having a top wall, side walls and a bottom wall adapted to be removably mounted within a window frame structure housing a window. The mounting frame is appointed to abut and sit against the window frame structure. Additionally, the mountable cover comprises a panel located within the mounting frame comprising a material adapted to interface with solar properties traversing the window and sit parallel to the window. The mountable cover further comprises fastening means appointed to engage with the window frame structure for mounting and removing the mounting frame from the window frame structure. Windows suitable for the mountable cover include a vast array of window structures, elevated windows, and skylights. The fastening means preferably comprises at least one aperture drilled therein adapted to receive a pin. Most preferably, at least four fastening means are provided comprising four apertures drilled in the mounting frame and mating pins that are adapted to be received therein. In another embodiment, the fastening means may comprise at least one "L" shaped member having an opening adapted to receive a screw and having a bottom prong adapted to secure the mounting frame.

The window or skylight cover can additionally be attached to the window glass framing of standard and custom size windows to accomplish sun blocking and decorative functions.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE DISCLOSURE

Figure 1A:
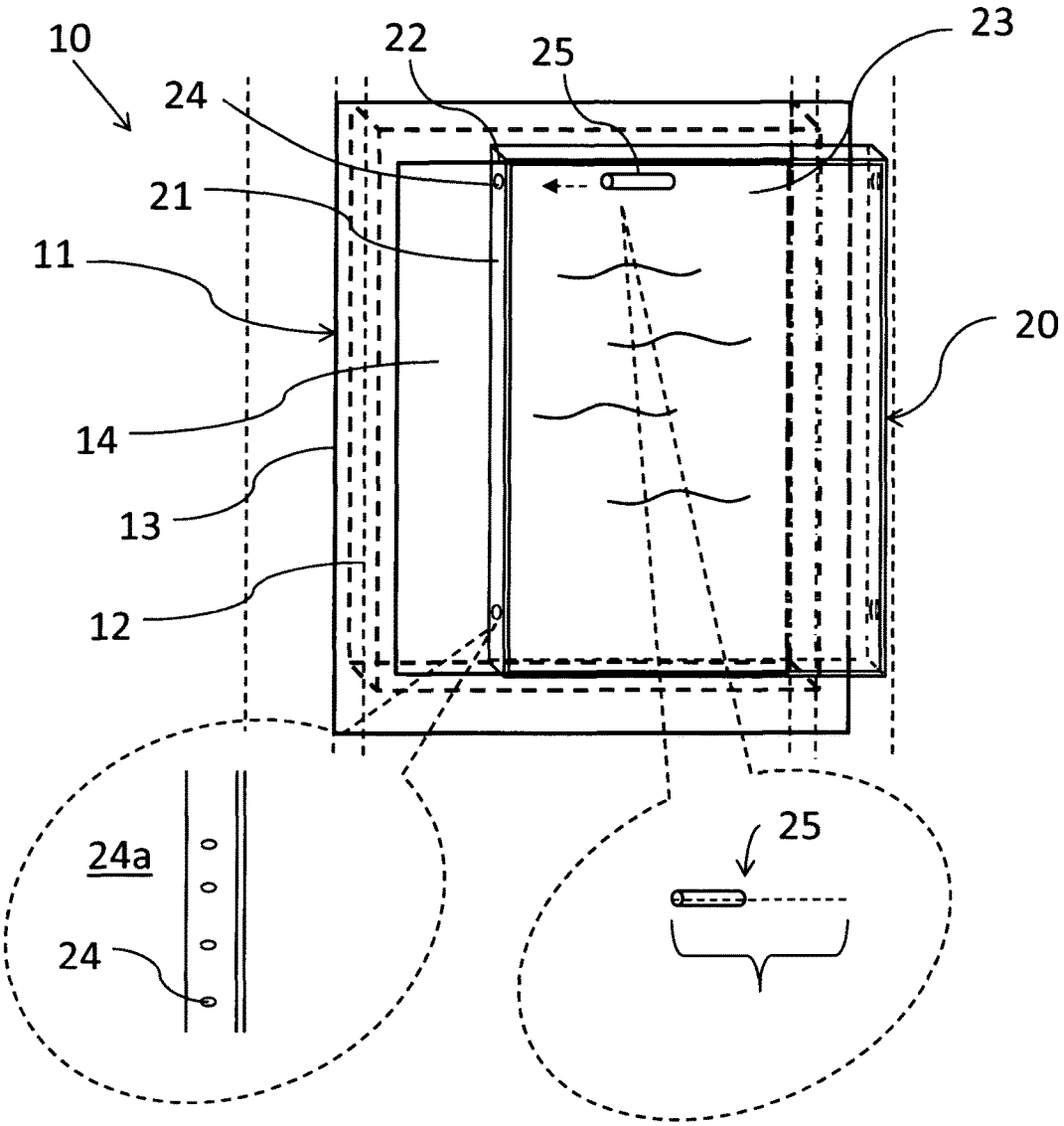
FIG. 1*a* illustrates a top plan view of an embodiment of the mountable cover being inserted into a window/skylight.

The best mode for carrying out the present disclosure is presented in terms of the embodiments herein. The embodiment(s) described herein detail for illustrative purposes and is subject to many variations. It is understood that various omissions and substitutions of equivalents are contemplated as circumstances may suggest or render expedient, but are intended to cover the application or implementation without departing from the spirit or scope of the present disclosure. Further, it is to be understood that the phraseology and terminology employed herein are for the purpose of the description and should not be regarded as limiting. The headings utilized within the description are for convenience only and have no legal or limiting effect.

The subject invention is directed to a mountable cover, blind and/or shade for a window or skylight. The mountable cover, blind and/or shade for a window or skylight provides a widow covering, particularly contemplating a skylight cover, or blind, composed of a light weight material and having four pins/fastening means so that it is easy to install and to clean. The mountable cover is designed to provide several advantages over other blind/shade devices. It functions to minimize solar heat and light from coming in through a skylight or window, to keep the heat in during the winter or colder months, and to keep the heat out in hotter months. It provides significant advantageous over other blinds and shades in that it does not require extensive mounting parts or energy. It does not require any manipulation of the existing window frame, leaving the existing window frame with just a pin hole or small hole. Ease of installation is achieved in a manner so that a lay person can mount the cover him/herself without the need to call in a contractor or professional. As a result, cost savings in installation are immediately realized. Additionally, the subject mount cover does not include any expensive moving parts, motors or reels. As a result, the subject mount cover is much more cost effective in manufacturing, packaging and transporting. Further, it is less susceptible to wear and tear and damage as it does not have any delicate moving parts or motors. The mount cover is easily installed as it is lightweight and preferably requires minimal drilling or nailing to the window frame. It is attractive, and easy to clean or take care of and can readily be changed or switched out to suit a particular need or to change for decorative purposes. The panel may be composed of a plethora of materials having different colors and/or designs, and the material may be transparent or opaque, depending on the desired functions/needs of the user. Preferably, the panel is constructed of a woven material composed of cellular, cotton, linen, polyester, wool, viscose and silk. Alternatively, the woven material is composed of vinyl, polyester, aluminum or Polyvinyl chloride (PVC). The material may be constructed to provide the ability to still look out of the window, yet provide privacy in shading so that an outsider cannot look into the window. Due to its structure, it can be mounted in a matter of minutes, or removed and taken down for cleaning. Once the mount cover is removed from the window, the total glass/window frame is exposed for cleaning.

Fastening or mounting of the mountable cover is carried out through use of fastening means. Preferably, the fastening means comprises four apertures in the frame that are adapted to receive four pins, respectively, therein. In another embodiment, the fastener means is comprised of 4 "L" shaped brackets that are screwed or pushed into the window frame. This holds the cover flush to the ceiling or a pin is inserted under the mounting frame or through a drilled hole of the cover on the side, preferably being screwed into the sheet rock or abutting frame around the skylight/window. Accordingly, when placed over the skylight, the mounting cover can cradle or sit on top of the holder and/or pins may be used.

The mountable cover provides a shade that is lightweight and readily placed in position under a sky light to keep the surrounding environment cooler in summer and warmer in winter. It also prevents the sun's rays from fading carpets and upholstery. Generally, skylights come in conventional sizes and the mountable cover is offered in a variety of sizes, including the conventional sizes of skylights for flush clean fitting. The pins for fastening means can be made in different sizes. The mountable cover shade/blind can be premade in the conventional sizes or can be custom made or sized. Materials composing the mountable cover can vary. The mountable cover preferably has a variety of functions, including blocking light, reducing heat buildup, and insulating properties to keep heat in during colder/winter months. Pins are constructed as short pins or longer pins.

The term window frame herein includes window frame structures formed in dry wall and/sheet rock, window frames secured to a structures wall or ceiling, or window frame structures directly abutting window glass. The subject mountable cover may be mounted within any of the aforesaid frame structures and may be stationary, such as for stationary windows including skylights generally, or movable, such as for movable windows such as sliding glass doors or double hung windows. Where the mountable cover is mounted within a movable window structure, the cover is mounted within the shallow frame directly abutting the glass so that the cover, frame and window move together as a unit. When being utilized with mounted windows, the frame of the mountable cover itself is very shallow in depth so that it preferably sits substantially flush within the movable window frame. For example, see FIGS. 10*a*-10*e* herein.

Figure 1B:
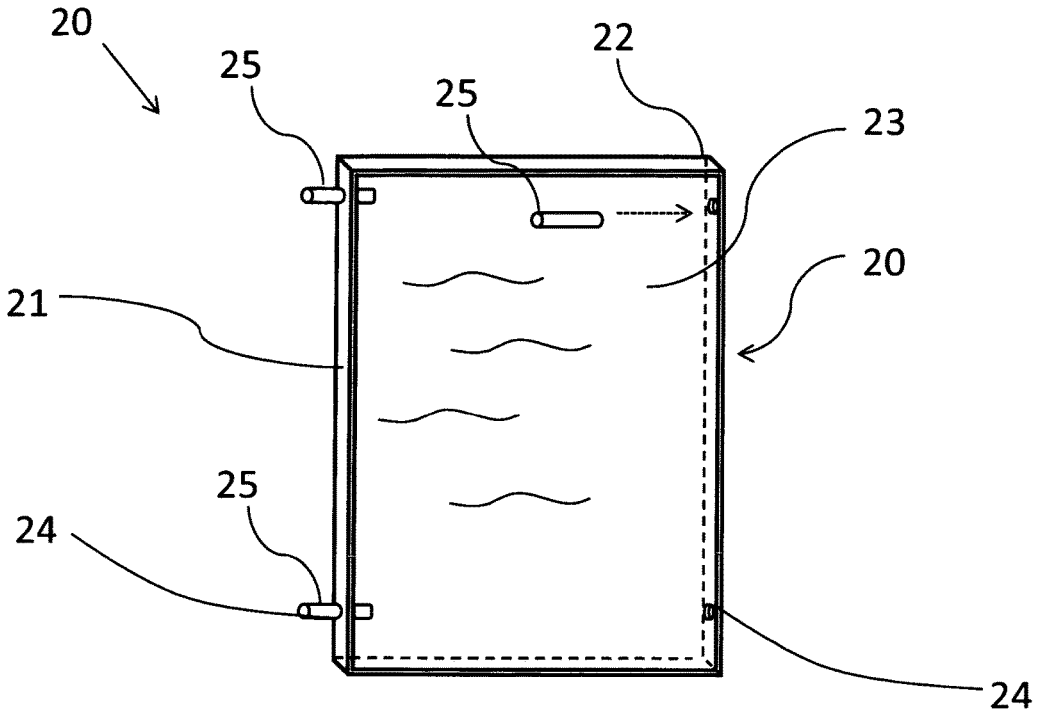
FIG. 1*b* illustrates a top plan view of the mountable cover of FIG. 1*a* removed from the window/skylight.
Figure 1C:
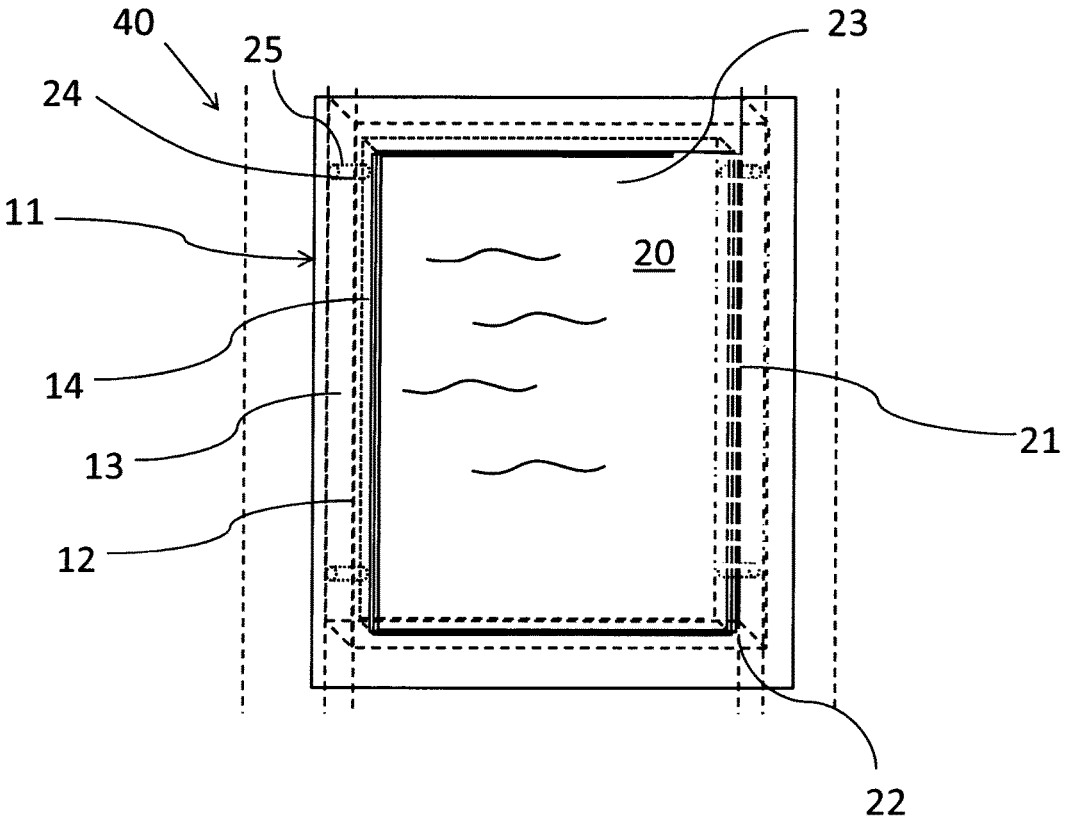
FIG. 1*c* illustrates the mountable cover of FIG. 1*a* mounted in the window/skylight.
Figure 2:
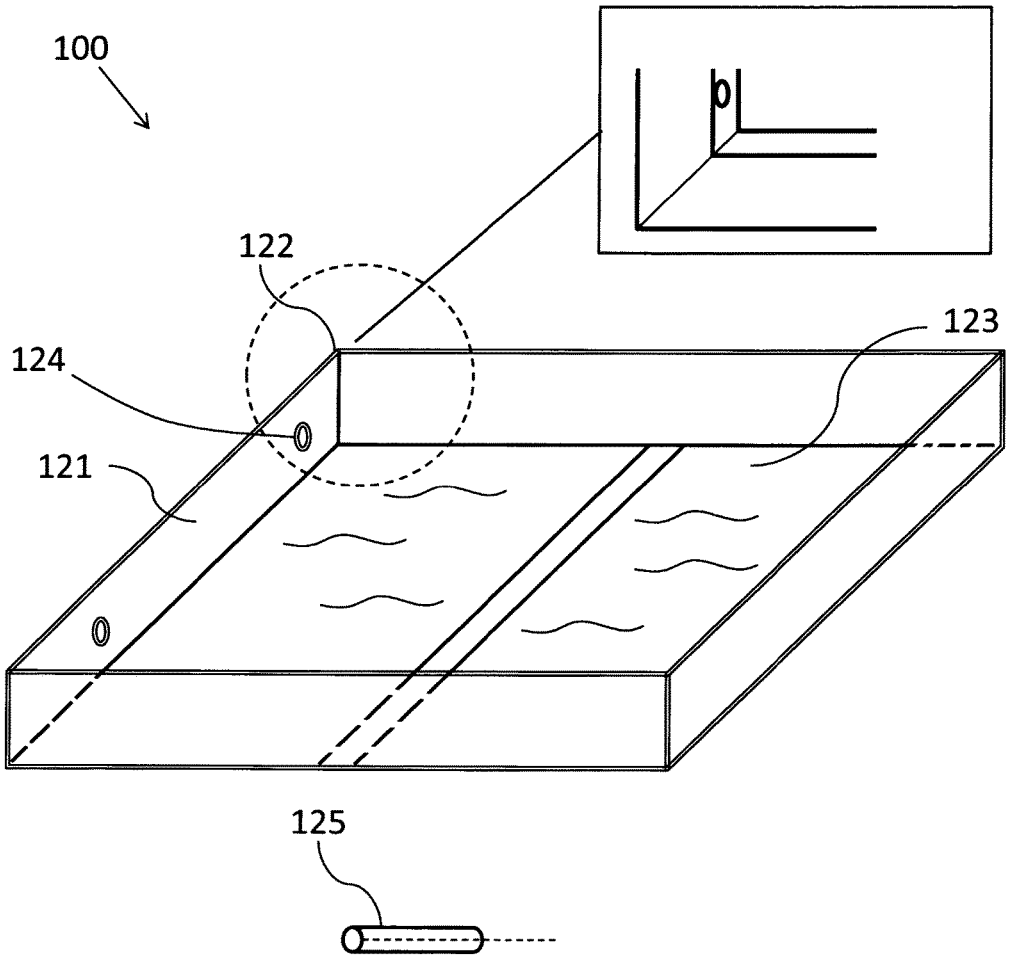
FIG. 2 illustrates a top plan view of an embodiment of the mountable cover.

FIGS. 1*a*-1*c* illustrate an embodiment of the mountable cover. FIG. 1*a* illustrates a top plan view of the mountable cover being inserted into a window/skylight, shown generally at 10. FIG. 1*b* illustrates a top plan view of the mountable cover removed from the window/skylight, shown generally at 20. FIG. 1*c* illustrates the mountable cover 20 mounted the window/skylight, shown generally at 40. FIG. 2 illustrates another embodiment of the mountable cover, showing a top plan view of the mountable cover generally at 100.

As shown generally in FIGS. 1*a*-1*c*, the mountable cover is adapted to be removably and easily inserted into a window 11. Window 11 may be any window construct, but preferably is a skylight window. Window 11 is constructed as a typical window structure having a window frame 12, molding 13 and glass 14. Mountable cover 20 is adapted to be inserted within window frame 12 to sit flush within frame 12. Mountable cover 20 is constructed having a mounting frame 21 forming corners 22 (flat or angled), with an insert panel 23 located therein. Insert panel 23 is constructed as a blind, window cover, heat reflective material, and/or heat insulation material to provide a window covering for window 11. Mounting frame 21 includes at least one aperture 24 drilled therein adapted to receive a pin 25. A plurality of apertures may be provided as shown at 24*a*. Preferably, aperture 24 is located near a corner of frame 21 as shown. Preferably there are at least two apertures 24 located on at least one side of the mounting frame 21 as shown. Alternatively, there may be at least two more apertures 24 located on the opposing side of the mounting frame 21 as shown in FIGS. 1*a*-1*c*. Pin 25 is adapted to be received within and traverse aperture 24 to protrude therefrom abutting tightly against window frame 12 so that the mountable cover 20 is secured within window 11. Pin 25 can be constructed having a variety of widths and lengths and can have a flat top or a pointed top for abutting the window frame 12 for securement. Mounting frame 21 can be composed of a plethora of materials, including wood materials that correspond to typical wood colors/plastic colors utilized for current window 11 frames 12.

Referring to FIG. 2, the mountable cover is generally shown at 100 and is adapted to be inserted into a window as discussed hereinabove pertaining to FIGS. 1*a*-1*c*. Mountable cover 100 is adapted to be inserted within a window frame to sit flush therein. Mountable cover 100 is constructed having a mounting frame 121 forming corners 122, with an insert panel 123 located therein. Insert panel 123 is constructed as a blind, window cover, heat reflective material, and/or heat insulation material. Mounting frame 121 includes at least one aperture 124 drilled therein adapted to receive a pin 125. Preferably, aperture 124 is located near a corner of frame 121 as shown. Preferably there are at least two apertures 124 located on at least one side of the mounting frame 121 as shown. Alternatively, there may be at least two more apertures 124 located on the opposing side of the mounting frame 121. Pin 125 is adapted to be received within and traverse aperture 124 to protrude therefrom abutting tightly against the window frame (not shown) so that the mountable cover 100 is tightly secured within the window.

Figure 3:
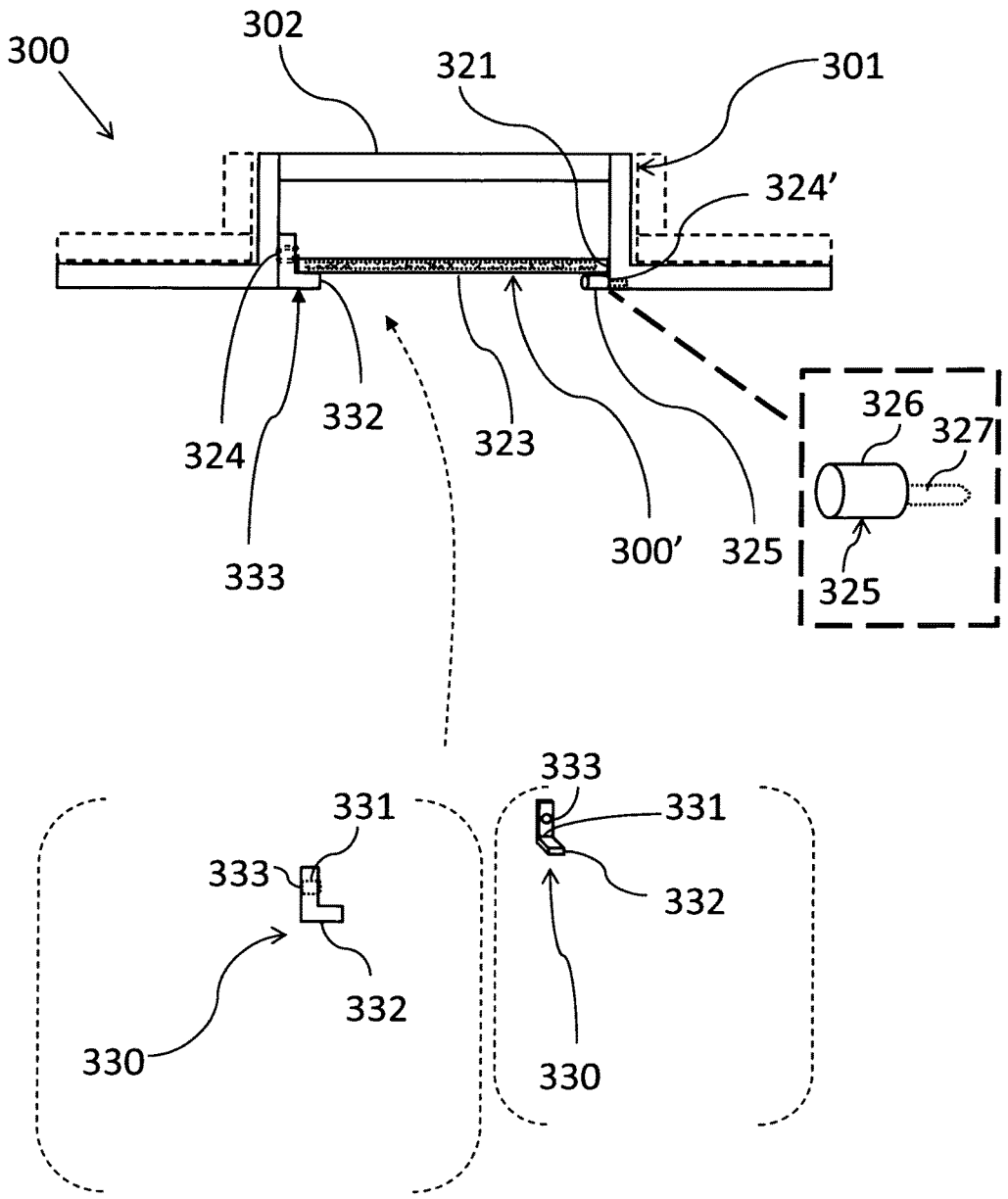
FIG. 3 illustrates a cross sectional view of an embodiment of the mountable cover, showing an alternative embodiment of the fastening means.

FIG. 3 illustrates a cross sectional view of an embodiment of the mountable cover, shown generally at 300. In this embodiment, an optional fastening means embodiment is shown. Mountable cover 300' is inserted into a window frame 301 with a window 302 therein, as discussed hereinabove pertaining to FIGS. 1*a*-1*c*. It is constructed having a mounting frame 321 with an insert panel 323 constructed as a blind, window cover, heat reflective material, and/or heat insulation material. An aperture 324 is drilled within window frame 301 which receives a screw that traverses a screw opening or hole 333 in an "L" shaped member 330. "L" shaped member 330 is constructed having a top portion 331 and bottom portion 332. Top portion 331 includes the apertures/screw hole 333 so that top portion 331 is tightened against the window frame 301 while bottom portion 332 acts as a shelf or support for mounting frame 321. An aperture 324' is located on the opposite side of the window frame 301 for receiving a pin 325 therein. Mounting frame 321 further rests on pin 325 which includes a peg portion 326 and a rod portion 327. Mounting frame 321 rests on the peg portion 326, which may be a square, rectangle or cylinder, while rod portion 327 is received within aperture 324' of window frame 301. In an alternative embodiment, at least two "L" shaped members are provided to be placed and mounted on the same side of the mounting frame 301; then on the opposite side thereof at least one aperture 324 is provided for receiving at least one pin 325. In this embodiment, the fastener means comprises at least one "L" shaped member that is screwed into the window frame to hold a portion or one side of the mounting frame, while the pin is inserted under the mounting frame on the opposite side, preferably being screwed into the sheet rock or abutting frame around the skylight/window. Accordingly, when placed over the skylight, the mounting cover can cradle or sit on top of the holder and/or pins may be used.

Skylight framing can be built in many different sizes, shapes and constructions. Framing for skylights can also have different dimensions, including flared framing. Moreover, spackling around a skylight often varies, and as a result different fastening methods for the subject cover are provided. The subject cover can be placed anywhere within the depth of the skylight framing. For example, "L" shaped members facilitate in preventing (1) minor damage of spackle over any corner metal guards; (2) the spackle being spread so thin that a pin can't go through; or (3) need for extra support if the cover is heavier in construct. The "L" shaped members allows the cover to mount flush to the ceiling by using four "L" shaped members or pins. It can also be easily fastened into the ceiling opening of the skylight by four pins, either pushed or screwed in place.

Figure 4:
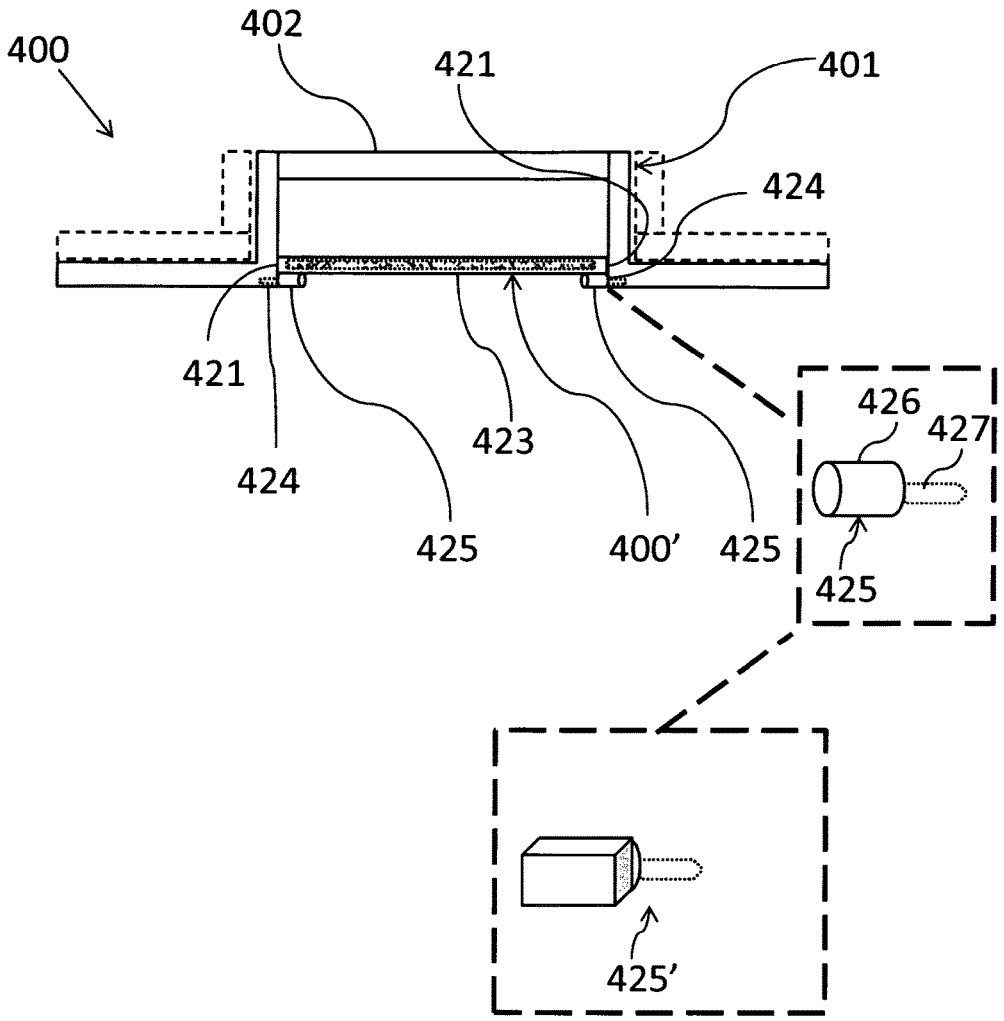
FIG. 4 illustrates a cross sectional view of an embodiment of the mountable cover, showing an alternative embodiment of the fastening means.

FIG. 4 illustrates a cross sectional view of an embodiment of the mountable cover, shown generally at 400. In this embodiment, an optional fastening means embodiment is shown. Mountable cover 400' is inserted into a window frame 401 with a window 402 therein. Apertures 424 are drilled in window frame 401. Mountable cover 400' is constructed having a mounting frame 421 with an insert panel 423 constructed as a blind, window cover, heat reflective material, and/or heat insulation material. Once the mounting panel 400' is placed within the window frame 401 pins 425 are inserted within the apertures 424 in the window frame 401. Mounting panel 400' is then released so that mounting frame 421 rests on pins 425 to securely sit within window frame 401. Pins 425 include a peg portion 426 and a rod portion 427. Mounting frame 421 rests on the peg portion 426, which may be a square (shown at 425'), rectangle or cylinder (as shown at 425), while rod portion 427 is received within aperture 424 of window frame 401. Preferably, rod portion 427 terminates to a tip that is pointed to provide grab or hold within a wooden window frame. In a preferred embodiment, at least four aperture 424 are drilled in window frame 401 and at least four pins 425 are then inserted within the apertures 424 to secure mountable cover 400'. Accordingly, when placed over the skylight, the mounting cover sits on top of the pins.

Figure 5A:
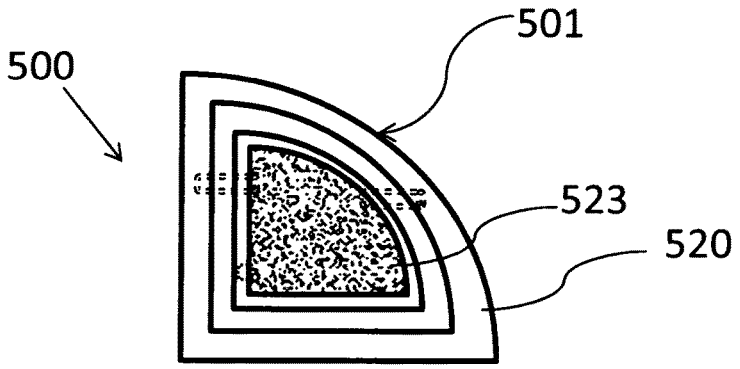
FIG. 5*a* illustrates a top plan view of an embodiment of the mountable cover.

FIG. 5*a* illustrates a top plan view of an embodiment of the mountable cover, shown generally at 500. In this embodiment, the mounting cover 501 is constructed having a quarter pie shape to address a particular window construct. The mounting cover 501 is shown as a rectangular frame assembly 521 with the panel 523 integrated therein. The figure illustrates an example of the plethora of shapes and configurations that the mountable cover can be formed as.

Figure 5B:
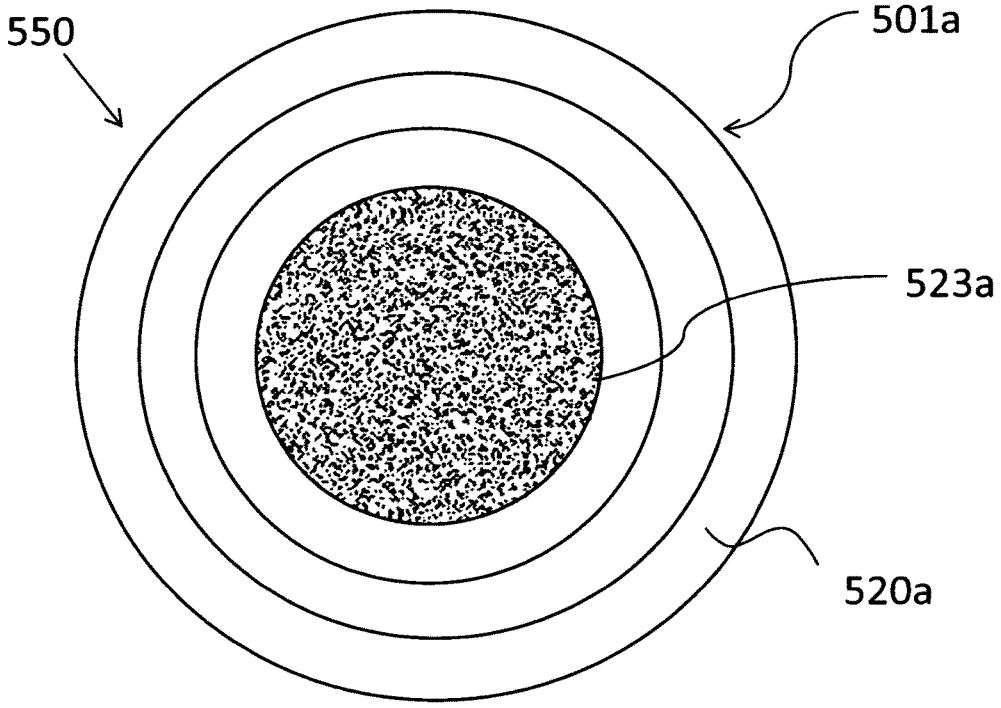
FIG. 5*b* illustrates a top plan view of an embodiment of the mountable cover.

FIG. 5*b* illustrates a top plan view of an embodiment of the mountable cover, shown generally at 550. In this embodiment, the mounting cover 501*a* is constructed having a quarter pie shape to address a particular window construct. The mounting cover 501*a* is shown as a rectangular frame assembly 521*a* with the panel 523*a* integrated therein. The figure illustrates an example of the plethora of shapes and configurations that the mountable cover can be formed as.

Figure 6:
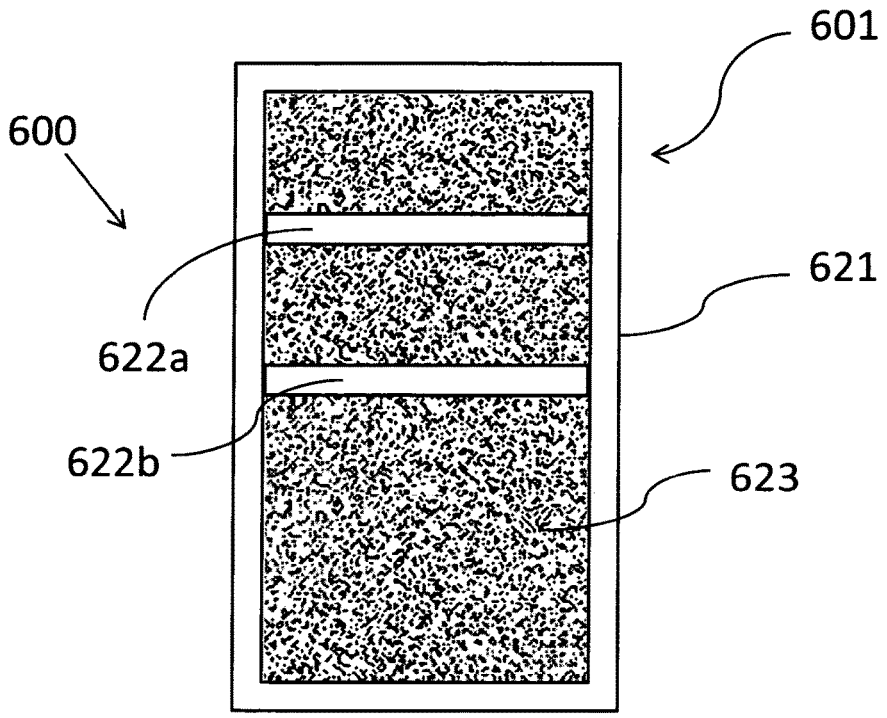
FIG. 6 illustrates a top plan view of an alternate embodiment of the mountable cover.

FIG. 6 illustrates a top plan view of an embodiment of the mountable cover, shown generally at 600. In this embodiment, the mounting cover 601 is shown as a rectangular frame assembly 621 with the panel 623 integrated therein. The frame assembly 621 is shown having cross-bars 622*a*, 622*b* placed to provide both style and to provide structural support and strength to the mounting cover 601.

Figure 7:
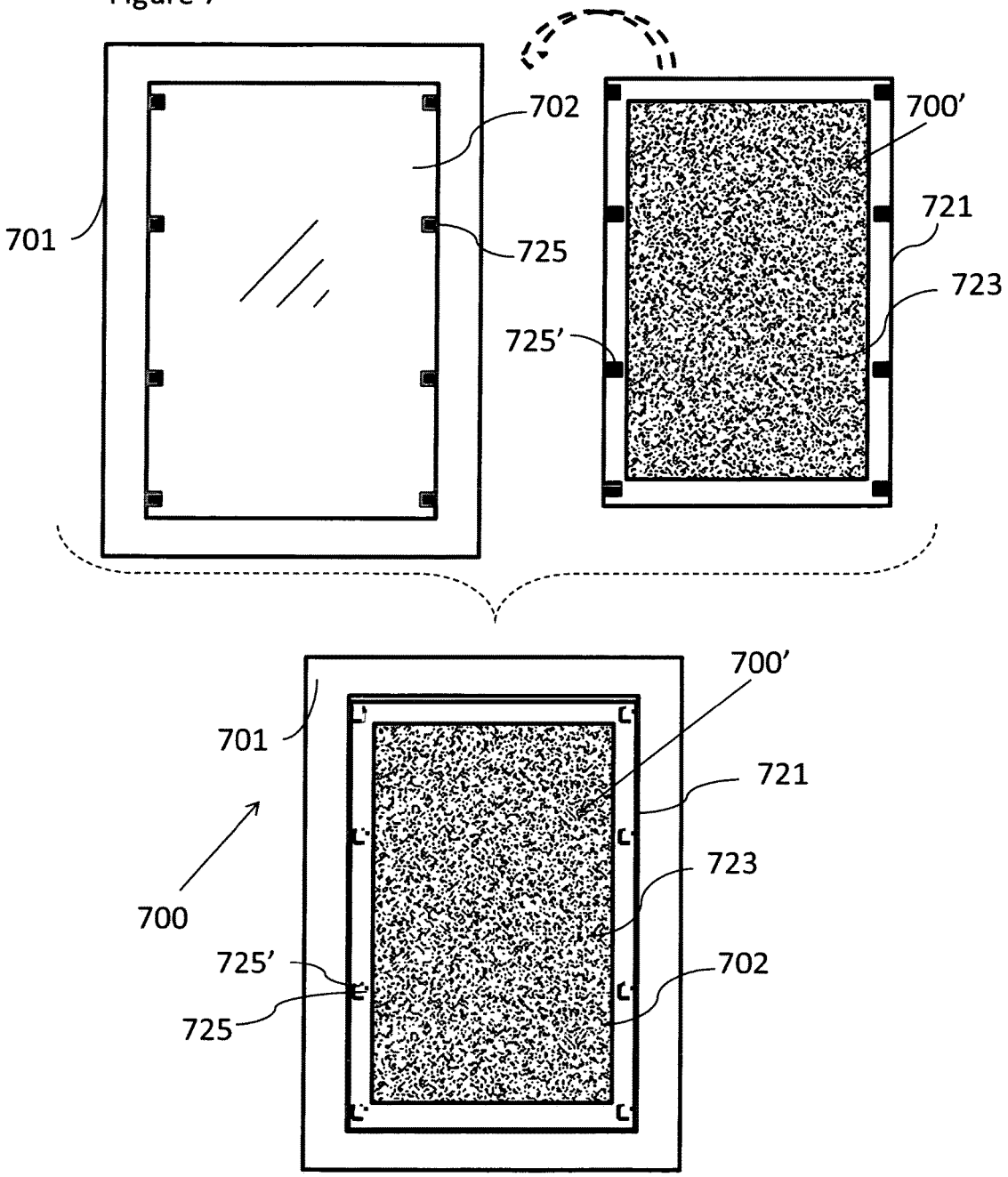
FIG. 7 illustrates a top plan view of an alternate embodiment of the mountable cover, showing an option for the fastening means to mount the cover within the stationary window, wherein fastening means are provided as hook and loop fasteners.
Figure 8:
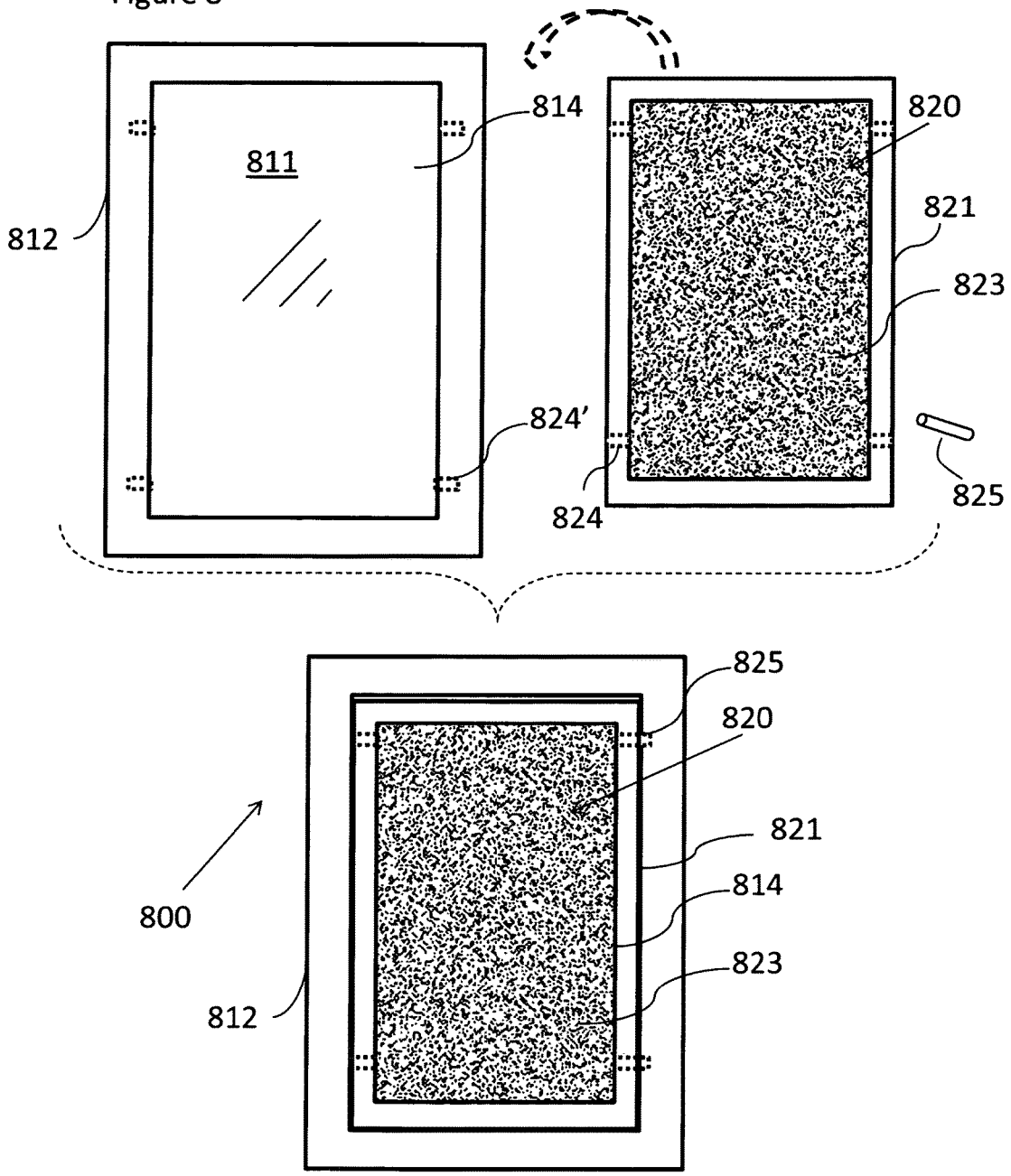
FIG. 8 illustrates a top plan view of an alternate embodiment of the mountable cover, showing an option for the fastening means to mount the cover within the stationary window, wherein fastening means are provided as apertures or drilled holes receiving a pin.
Figure 9:
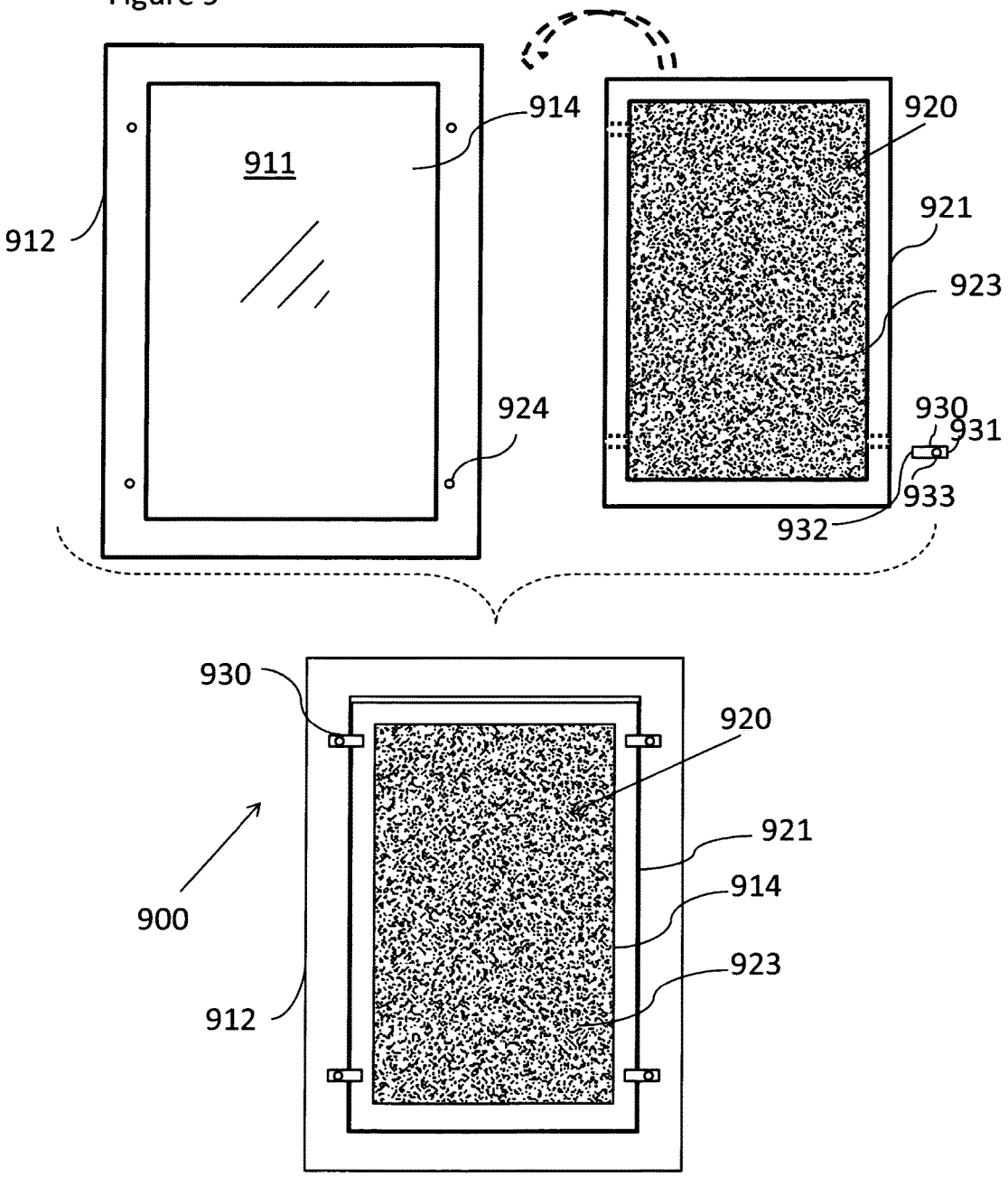
FIG. 9 illustrates a top plan view of an alternate embodiment of the mountable cover, showing an option for the fastening means to mount the cover within the stationary window, wherein fastening means are provided as a pin and a flat bracket.

FIGS. 7-9 illustrate various constructions of the fastening means for the subject mountable cover.

FIG. 7 illustrates a top plan view of an alternate embodiment of the mountable cover, showing an option for the fastening means to mount the cover within the stationary window, shown generally at 700. In the embodiment shown at 700 fastening means are provided as hook and loop fasteners, such as those commonly sold under the trade name VELCRO. Mountable cover 700' is inserted into a window frame 701 with a window 702 therein. Hook and loop fasteners 725 are mounted onto the window 702. Hook and loop fasteners 725 are constructed as discrete portions or squares in the embodiment shown, formed having an adhesive back surface and a hook/loop top surface. Adhesive back surface has a peel tab thereon which is removed so expose the adhesive back surface for adhering the fastener 725 to the window 702. Herein, the fasteners 725 are shown adhered to the window glass itself, alternatively the fasteners 725 may be adhered to the window frame 701 abutting the window 702. Hook and loop fasteners 725 are herein shown as small squares, alternatively the fasteners 725 may be constructed as elongated strips corresponding to the shape of the window 702 upon which the cover 700' is to be mounted.

Mountable cover 700' is constructed having a mounting frame 721 with an insert panel 723 constructed as a blind, window cover, heat reflective material, and/or heat insulation material or decorative surface. Frame 721 includes mating hook and loop fasteners 725' corresponding in construction, size, shape and orientation placement to fasteners 725 located on window 702. Once fasteners 725, 725' are placed on the window 702 and frame 721 of mountable cover 700' the fasteners are engaged so that the cover 700' is secured over window 702.

FIG. 8 illustrates a top plan view of an alternate embodiment of the mountable cover, showing an option for the fastening means to mount the cover within the stationary window, shown generally at 800. In the embodiment shown at 800 fastening means are provided as apertures or drilled holes receiving a pin. Window 811 is constructed having a window frame 812 with molding and glass window 814. Mountable cover 820 is adapted to be inserted within window frame 812. Mountable cover 820 is constructed having a mounting frame 821 with an insert panel 823 constructed as a blind, window cover, heat reflective material, and/or heat insulation material. Mounting frame 821 includes apertures 824 drilled therein adapted to receive a pin 825. Window frame 812 includes correspondingly located drilled holes 824'. Pin 825 is adapted to be received within and traverse aperture 824 and drilled holes 824' in window frame 812 to secure mountable cover 820 within window frame 812. Pin 825 can be constructed having a variety of widths and lengths as discussed hereinabove.

FIG. 9 illustrates a top plan view of an alternate embodiment of the mountable cover, showing an option for the fastening means to mount the cover within the stationary window, shown generally at 900. In the embodiment shown fastening means are provided as a pin and a flat bracket. Window 911 is constructed having a window frame 912 with molding and window glass 914. Mountable cover 920 is adapted to be inserted within window frame 912. Mountable cover 920 is constructed having a mounting frame 921 with an insert panel 923 constructed as a blind, window cover, heat reflective material, and/or heat insulation material. Holes 924 are drilled within window frame 912 which receives a screw that traverses a screw opening or hole 933 in bracket member 930, herein shown as a rectangular bracket constructed having a first portion 931 and second portion 932. First portion 931 includes the apertures/screw hole 933 so that top portion 931 is tightened against the window frame 912 while second portion 932 acts as a shelf or support for mounting frame 921.

FIGS. 10*a*-10*e* illustrate views of the subject mountable cover inserted in a manner so that it can move within a movable window frame. Such movable window frames contemplated, but non-limiting include: sliding glass windows, French doors, glass doors, double hung windows, etc. Varying sizes of the subject mountable cover can be provided so as to fit within a single window pane or to fit within the abutting window frame. Preferably, the mountable cover is offered having a thin or shallow thickness or depth so that it sits substantially flush within the abutting window frame and so that the cover is lightweight.

Figure 10A:
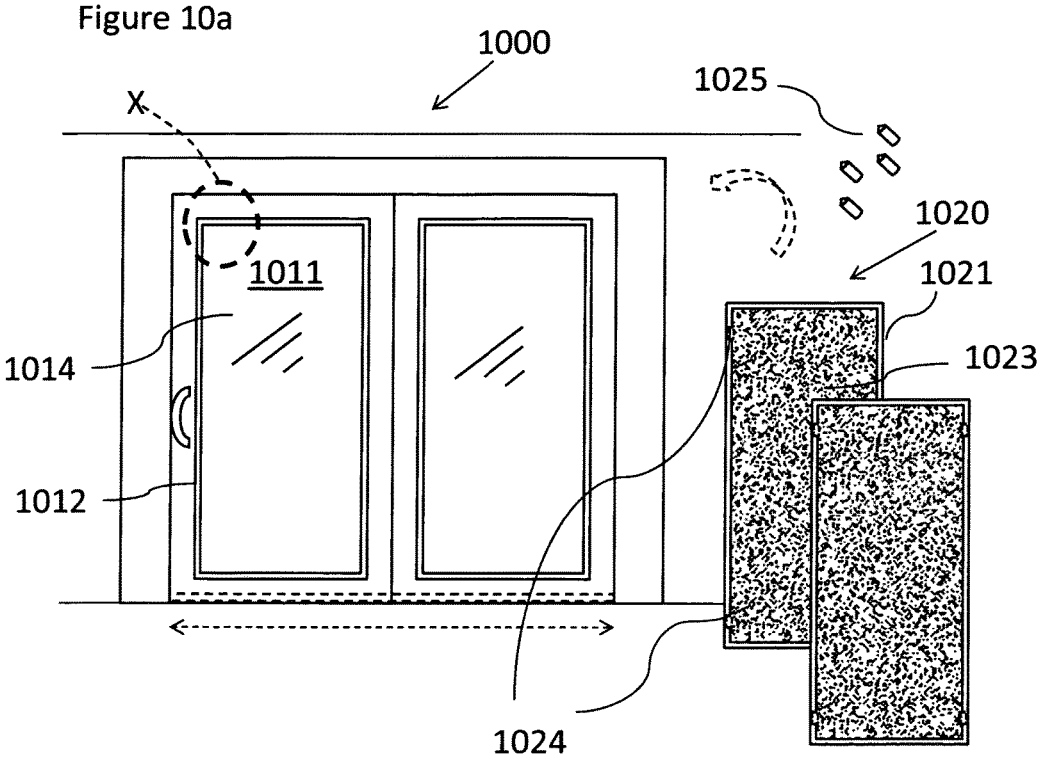
FIG. 10*a* illustrates a top plan view of an embodiment of the subject mountable cover, wherein the mountable cover is being mounted within a movable window frame structure, such as a sliding glass door.
Figure 10B:
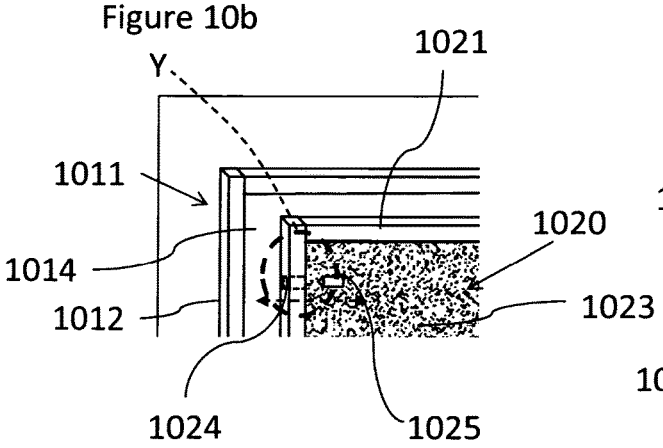
FIG. 10*b* illustrates a cross-sectional view taken at X in FIG. 10*a*, showing the mountable cover being mounted window frame structure/sliding glass door.
Figure 10C:
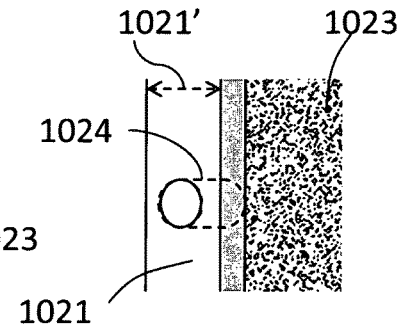
FIG. 10*c* illustrates a cross-sectional exploded side view of the mountable cover's frame taken at Y in FIG. 10*b;*
Figure 10D:
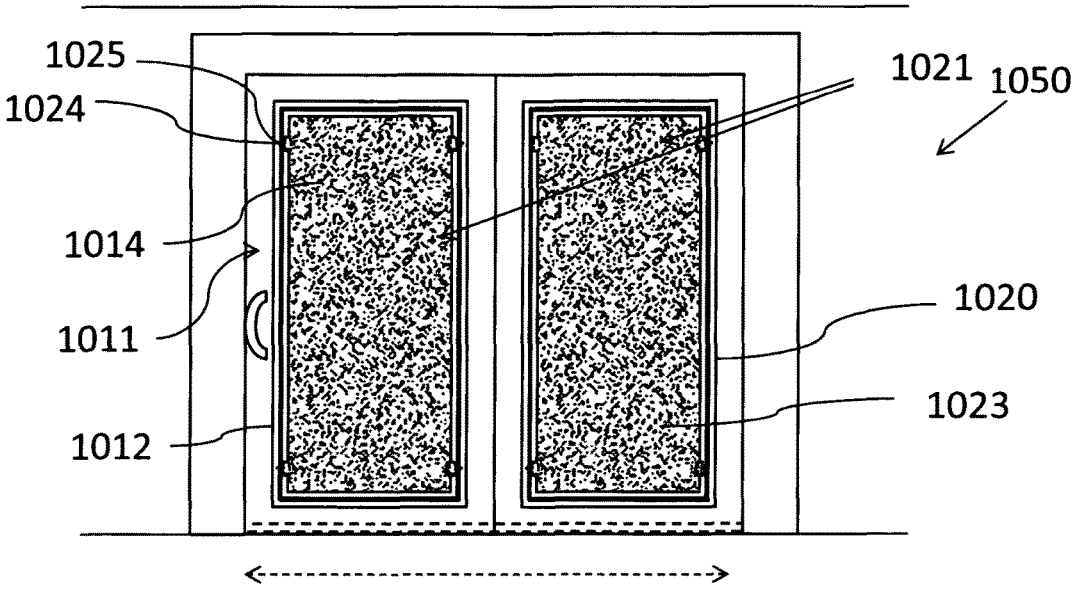
FIG. 10*d* illustrates a top plan view of the embodiment of FIG. 10*a* mounted within the movable window frame structure/sliding glass door with the doors in the closed configuration.

FIG. 10*a* illustrates a top plan view of an embodiment of the subject mountable cover, wherein the mountable cover is being mounted within a movable window frame structure, such as a sliding glass door, shown generally at 1000. FIG. 10*b* illustrates a cross-sectional view taken at X in FIG. 10*a*, showing the mountable cover being mounted window frame structure/sliding glass door. FIG. 10*c* illustrates a cross-sectional exploded side view of the mountable cover's frame taken at Y in FIG. 10*b*. FIG. 10*d* illustrates a top plan view of the embodiment of FIG. 10*a* mounted within the movable window frame structure/sliding glass door with the doors in the closed configuration, shown generally at 1050. Lastly, FIG. 10*e* illustrates a top plan view of the embodiment of FIG. 10*a* mounted within the movable window frame structure/sliding glass door with the sliding door slid to the open configuration, shown generally at 1055.

Referring to FIGS. 10*a*-10*e*, it is noted that in the embodiment shown fastening means are provided as apertures or drilled holes receiving a pin, however other fastening means such as those described in detail herein may be implemented. Window 1011 is constructed as a sliding glass window structure having a window frame 1012 with molding that directly abuts with glass window 1014 and moves along with the window 1014. Frame 1012 is generally a shallow depth frame structure of roughly 1" to 3" in depth. Mountable cover 1020 is adapted to be inserted within window frame 1012. Mountable cover 1020 is constructed having a mounting frame 1021 with an insert panel 1023 constructed as a blind, window cover, heat reflective material, and/or heat insulation material. Mounting frame 1021 has a correspondingly shallow depth, generally having a shallow depth frame structure of roughly 0.5" to 3" in depth as shown at 1021' in FIG. 10*c*. Mounting frame 1021 includes apertures 1024 drilled therein adapted to receive a pin 1025. Window frame 1012 may include correspondingly located drilled holes, or alternatively pin 1025 may be pressed firmly against the window frame 1012 so that it adequately secures the cover 1020 therein. Alternative fastening means, including the ones discussed herein, are also contemplated. Pin 1025 may include a pointed tip for gripping the window frame 1012. Pin 1025 is adapted to be received within and traverse aperture 1024 and grip or tightly abut window frame 1012 to secure mountable cover 1020 within window frame 1012. Pin 1025 can be constructed having a variety of widths and lengths an may be sized to sit flush within mounting frame 1021, and may include locking mechanisms, such as locking teeth or screw grooves/teeth with corresponding screw grooves/teeth within aperture 1024, to help lock the pin 1025 in place, and visa vie the cover 1020, and prevent it from sliding out of aperture 1024.

Figure 10E:
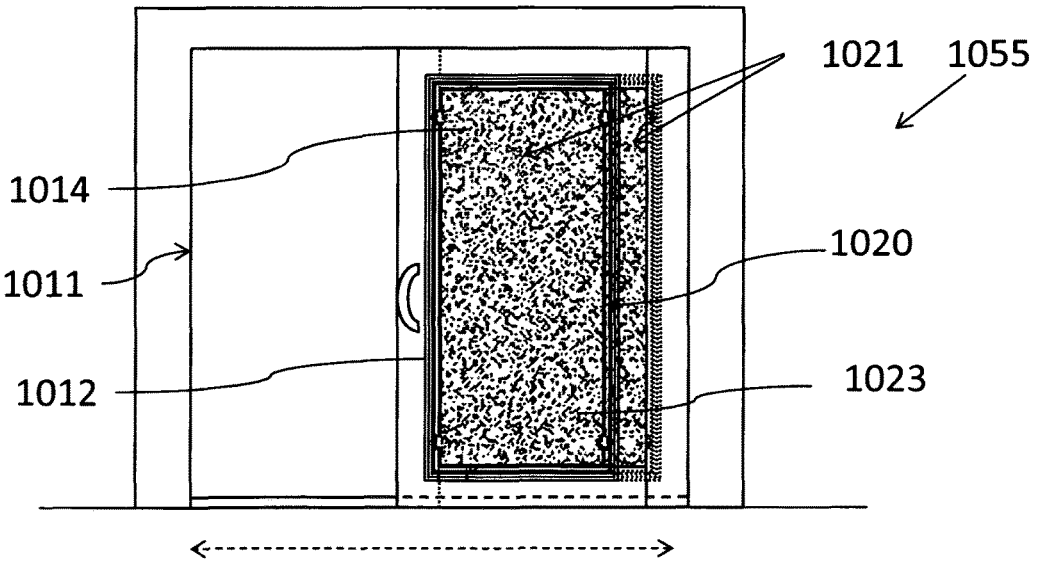
FIG. 10*e* illustrates a top plan view of the embodiment of FIG. 10*a* mounted within the movable window frame structure/sliding glass door with the sliding door slid to the open configuration.

As illustrated in FIG. 10*e*, as the cover 1020 is mounted within the movable window frame structure 1012 of the sliding glass door 1011 it moves on the movable door when the door us in the open configuration, shown generally at 1055. Due to the mounting frame's 1021 shallow depth, when the moving glass door is opened, it can still readily slide over the stationary door without interference of the mountable cover of the non-moving door window panel.

Alternative features of the subject invention are contemplated and non-limiting including, for example: the mountable cover may be constructed in a plethora of shapes and sizes, and from a plethora of materials and colors; etc. These features are contemplated in combination with the main embodiments shown in the Figures. The shape of the mounting cover can be round, polygonal, rectangular, etc. In addition the mounting cover is suited for windows as well as skylights.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A window assembly comprising:

a window frame installable in a structure;

a window sash slidably movable within the window frame and including a window pane; and a mountable cover configured to be attached to the window sash, the mountable cover consisting of:

a mounting frame having a backside, a front side, a top wall, opposing side walls and a bottom wall, said backside of said mounting frame being configured to be removably mounted against and directly contacting the window pane, said backside of said mounting frame being configured to abut and sit flush against said window pane, wherein said front side of said mounting frame does not interact with or mount against said window sash, and wherein said mounting frame is not mounted within a groove, channel, or track;

a panel located within said mounting frame, said panel comprising a material capable of blocking or filtering light traversing said window pane, said panel adapted to sit parallel to and cover said window pane to block said light that has traversed said window pane;

fastening means configured to engage with said window sash for mounting and removing said mounting frame from said window sash;

said mounting frame having a thickness depth between 0.5 inches and 3 inches;

said material of said panel being constructed of a woven material having insulating and heat reflective properties for energy efficiency;

wherein said mountable cover is not integrated within said window sash so as to be separate from and configured to be removably mounted on said window sash; and said fastening means consisting of four apertures located on said side walls of said mounting frame, wherein each of said apertures is configured to receive a mating fitting pin that extends from the corresponding aperture to engage with said window sash, wherein said mating fitting pins are configured to be completely separable from the apertures of said side walls during mounting and removal of the mountable cover.

2. The mountable cover for a window as recited in claim 1, wherein said window assembly is a skylight.

3. The mountable cover for the window assembly as recited in claim 1, wherein said woven material is composed of cellular, cotton, linen, polyester, wool, viscose or silk.

4. The mountable cover for the window assembly as recited in claim 1, wherein said woven material is composed of vinyl, polyester, aluminum or Polyvinyl chloride (PVC).

5. The mountable cover for the window assembly as recited in claim 1, wherein said mounting frame is formed having flat frame corners.

6. The mountable cover for the window assembly as recited in claim 1, wherein said mounting frame is formed having angled frame corners.

7. The mountable cover for the window assembly as recited in claim 1, wherein said mountable cover is configured to cover only a portion of said window sash.

* * * * *